US010643572B2

(12) United States Patent
Holland et al.

(10) Patent No.: US 10,643,572 B2
(45) Date of Patent: May 5, 2020

(54) ELECTRONIC DISPLAY FRAME PRE-NOTIFICATION SYSTEMS AND METHODS

(71) Applicant: Apple Inc., Cupertino, CA (US)

(72) Inventors: Peter F. Holland, Los Gatos, CA (US); Arthur L. Spence, San Jose, CA (US); Christopher P. Tann, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/128,347

(22) Filed: Sep. 11, 2018

(65) Prior Publication Data

US 2020/0082783 A1 Mar. 12, 2020

(51) Int. Cl.

| | |
|---|---|
| ***G09G 5/00*** | (2006.01) |
| ***G09G 5/36*** | (2006.01) |
| ***G09G 5/10*** | (2006.01) |
| ***G09G 5/32*** | (2006.01) |
| ***G09G 5/395*** | (2006.01) |
| *G09G 3/3233* | (2016.01) |
| *G09G 3/36* | (2006.01) |

(52) U.S. Cl.

CPC ..... *G09G 5/006* (2013.01); *G09G 5/001* (2013.01); *G09G 5/10* (2013.01); *G09G 5/395* (2013.01); *G09G 3/3233* (2013.01); *G09G 3/3618* (2013.01); *G09G 2310/04* (2013.01); *G09G 2310/08* (2013.01); *G09G 2320/0247* (2013.01); *G09G 2320/0646* (2013.01); *G09G 2320/0666* (2013.01); *G09G 2330/021* (2013.01); *G09G 2354/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,704,839 | B2 | 4/2014 | Kobayashi | |
| 2014/0333642 | A1* | 11/2014 | Chiang | G06T 1/00 345/534 |
| 2015/0339994 | A1 | 11/2015 | Verbeure | |
| 2016/0275919 | A1* | 9/2016 | Lawrence | G09G 5/39 |
| 2017/0092236 | A1 | 3/2017 | Tripathi et al. | |
| 2017/0109859 | A1* | 4/2017 | Singh | G09G 3/20 |
| 2017/0352322 | A1 | 12/2017 | Spence et al. | |
| 2018/0308439 | A1* | 10/2018 | Cheng | G09G 3/2096 |
| 2019/0027114 | A1* | 1/2019 | Chu | G09G 5/006 |
| 2019/0051269 | A1* | 2/2019 | Kwa | G09G 5/393 |

* cited by examiner

*Primary Examiner* — Wesner Sajous
(74) *Attorney, Agent, or Firm* — Fletcher Yoder PC

(57) ABSTRACT

An electronic device may include a display panel to display an image and a display pipeline to process image data for the image. The display pipeline may include a controller to determine a first potential presentation time based on a maximum refresh rate of the display panel. The controller may also determine if a second target presentation time of a second image is equal to the first potential presentation time before a pipeline configuration time, and if the second target presentation time of the second image is equal to a second potential presentation time that occurs after the first potential presentation time and before a first pre-notification time occurring before the pipeline configuration time. The controller may output a first pre-notification signal at the first pre-notification time that instructs the display panel to pause self-refreshes until after the second image is displayed.

20 Claims, 11 Drawing Sheets

ELECTRONIC DISPLAY FRAME PRE-NOTIFICATION SYSTEMS AND METHODS

BACKGROUND

The present disclosure relates generally to electronic devices and, more particularly, to self-refreshing display technologies of the electronic devices having variable display durations.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices often use one or more electronic displays to present visual representations of information as text, still images, and/or video by displaying one or more images (e.g., image frames). For example, such electronic devices may include computers, mobile phones, portable media devices, tablets, televisions, virtual-reality headsets, and vehicle dashboards, among many others. In any case, to display an image, an electronic display may control light emission (e.g., luminance) of its display pixels based at least in part on corresponding image data.

For example, in a liquid crystal display (LCD), electrical energy may be stored in the pixel electrode of a display pixel to produce an electric field between the pixel electrode and a common electrode. This electric field may control orientation of liquid crystals and, thus, light emission from the display pixel. Additionally, in an organic light-emitting diode (OLED) display, electrical energy may be stored in a storage capacitor of a display pixel to control electrical power (e.g., current) supplied to a self-emissive component (e.g., OLED) and, thus, light emission from the display pixel.

Generally, electronic displays may display image frames based on target presentation times, for example, as indicated by a corresponding time stamp. However, in some instances, display durations of images may vary, for example, such that the durations do not correspond to predetermined intervals. A stored charge may gradually decrease over this display duration and, in some cases, may affect light emission from a display pixel, for example, perceivable as a visual artifact (e.g., a flicker, color distortion) on an electronic display. Thus, in some embodiments, an electronic display may self-refresh a displayed image frame to restore a stored charge to a display pixel. However, in some instances, timing of self-refreshes may conflict with target presentation times of other images.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure provides techniques to facilitate in providing a pre-notification for an image frame to be displayed on an electronic display. In some embodiments, an electronic device may include a display pipeline that processes image data before the image data is used to display corresponding image frames on its electronic display, for example, to facilitate improving perceived image quality. Additionally, in some embodiments, a display pipeline may process and transmit image data corresponding with an image frame to an electronic display while the electronic display is performing a self-refresh.

To facilitate reducing a likelihood of image data collisions occurring between new image data and refreshed image data, in some embodiments, a frame pre-notification signal may be transmitted by the display pipeline to communicate to an electronic display that new image data is incoming. In other words, in such embodiments, the electronic display may perform normal self-refresh operations until receiving notification that new image data is about to be transmitted. Upon receiving the frame pre-notification signal, the electronic display may halt (e.g., pause) self-refresh operations while the new image data is received by the electronic display, reducing a likelihood of image data collisions. In this manner, the electronic device may display image frames via its electronic display with improvements to perceived image quality as data collisions between new image data and refreshed image data may be reduced or even eliminated.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
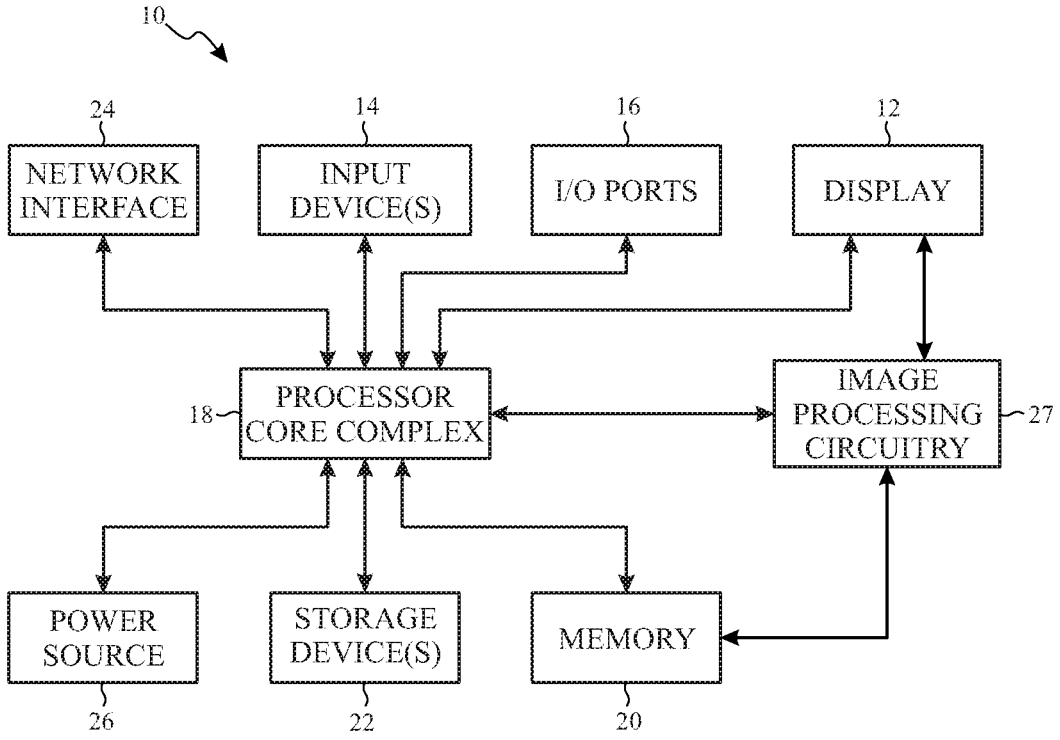
FIG. 1 is a block diagram of an electronic device with an electronic display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Generally, an electronic device may include devices or circuits that, in operation, consume (e.g., use) electrical power to render images for display on an electronic display associated with the electronic device. For example, electronic devices may include a processor that renders image frames by generating corresponding image data, which may be stored in memory. Additionally, electronic devices may include a display pipeline that retrieves and processes the image data before the image data is used to display the image frame on an electronic display, for example, to facilitate improving perceived image quality of the image frame.

Based at least in part on received image data, the electronic display may control light emission (e.g., luminance) of its display pixels to facilitate information communication by displaying a corresponding image frame. For example, in a liquid crystal display (LCD), electrical energy may be stored in the pixel electrode of a display pixel to produce an electric field between the pixel electrode and a common electrode, which controls orientation of liquid crystals and, thus, light emission from the display pixel. Additionally, in an organic light-emitting diode (OLED) display, electrical energy may be stored in a storage capacitor of a display pixel to control electrical power (e.g., current) supplied to a self-emissive component (e.g., OLED) and, thus, light emission from the display pixel. However, electronic devices, such as wearable or portable electronic devices, often store a finite amount of electrical energy.

To facilitate reducing power consumption, an electronic device may implement a variable display duration for a particular image frame. In some embodiments, electronic devices account for variable display duration by associating image frames with presentation times. However, at least in some instances, stored charge of a display pixel may gradually decrease while implementing the variable display duration. Since luminance of a display pixel is based on the stored charge of the display pixel, such decreases may affect perceived luminance (e.g., by creating a visual artifact and/or a flicker). To reduce likelihood of producing perceptible changes in luminance, an electronic display may self-refresh. For example, an electronic display may self-refresh by repeating a displayed image frame. By repeating a displayed image frame, a stored charge of a display pixel may be renewed and a luminance may be restored of the display pixel.

In some instances, timing of new image data for display and timing of refreshed image data may conflict. For example, when processing of refreshed image data has already started, processing of a new image frame may wait until processing of the refreshed image data completes before beginning. At least in some instances, this waiting may cause an actual delay in presentation time of the new image data relative to its target presentation time. When perceivable, such delay may affect perceived responsiveness of electronic devices, for example, to user inputs.

Accordingly, the present disclosure provides techniques for arbitrating processing of new image data and refreshed image data, for example, to reduce a likelihood of timing conflicts, and, thus, effects on perceived responsiveness of an electronic device. In some embodiments, an electronic device may include a display pipeline that processes image data before output to an electronic display for display of a corresponding image frame. To facilitate arbitrating image data processing, the display pipeline may output a frame pre-notification signal several sub-frames (e.g., 240 Hz frame, one quarter of a 60 Hz frame duration) prior to a target presentation time of an image frame to halt a self-refresh.

In particular, the display pipeline may output a frame pre-notification signal several sub-frames prior to a target presentation time to an electronic display. The frame pre-notification signal may be a signal, a flag, a bit, or a different suitable indication transmitted from the display pipeline to communicate an incoming frame to the electronic display. In response to receiving the frame pre-notification signal, the electronic display may perform an action, for example, to stop or pause initiation of a new self-refresh process. In this manner, perceivable responsiveness of an electronic display, for example, in response to user input, may be improved by reducing likelihood that a self-refresh of the electronic display delays presentation time of an image frame.

To help illustrate, an electronic device 10 including an electronic display 12 is shown in FIG. 1. As is described in more detail below, the electronic device 10 may be any suitable electronic device, such as a computer, a mobile phone, a portable media device, a tablet, a television, a virtual-reality headset, a vehicle dashboard, and the like. Thus, it should be noted that FIG. 1 is merely one example of a particular embodiment and is intended to illustrate the types of components that may be present in an electronic device 10.

In the depicted embodiment, the electronic device 10 includes the electronic display 12, one or more input devices 14, one or more input/output (I/O) ports 16, a processor core complex 18 having one or more processor(s) or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. Thus, the processor core complex 18 may execute instructions stored in local memory 20 and/or the main memory storage device 22 to perform operations, such as generating and/or transmitting image data. As such, the processor core complex 18 may include one or more general purpose microprocessors, one or more application specific integrated circuits (ASICs), one or more field programmable logic arrays (FPGAs), or any combination thereof.

In addition to instructions, the local memory 20 and/or the main memory storage device 22 may store data to be processed by the processor core complex 18. Thus, in some embodiments, the local memory 20 and/or the main memory storage device 22 may include one or more tangible, non-transitory, computer-readable mediums. For example, the local memory 20 may include random access memory (RAM) and the main memory storage device 22 may include read only memory (ROM), rewritable non-volatile memory such as flash memory, hard drives, optical discs, and/or the like.

As depicted, the processor core complex 18 is also operably coupled with the network interface 24. In some embodiments, the network interface 24 may facilitate communicating data with another electronic device and/or a network. For example, the network interface 24 (e.g., a radio frequency system) may enable the electronic device 10 to communicatively couple to a personal area network (PAN), such as a Bluetooth network, a local area network (LAN), such as an 802.11x Wi-Fi network, and/or a wide area network (WAN), such as a 4G or Long-Term Evolution (LTE) cellular network.

Additionally, as depicted, the processor core complex 18 is operably coupled to the power source 26. In some embodiments, the power source 26 may provide electrical power to one or more components in the electronic device 10, such as the processor core complex 18 and/or the electronic display 12. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the one or more I/O ports 16. In some embodiments, I/O ports 16 may enable the electronic device 10 to interface with other electronic devices. For example, when a portable storage device is connected, the I/O port 16 may enable the processor core complex 18 to communicate data with the portable storage device.

As depicted, the electronic device 10 is also operably coupled with the one or more input devices 14. In some embodiments, an input device 14 may facilitate user interaction with the electronic device 10, for example, by receiving user inputs. Thus, an input device 14 may include a button, a keyboard, a mouse, a trackpad, and/or the like. Additionally, in some embodiments, an input device 14 may include touch-sensing components in the electronic display 12. In such embodiments, the touch-sensing components may receive user inputs by detecting occurrence and/or position of an object touching the surface of the electronic display 12.

In addition to enabling user inputs, the electronic display 12 may include a display panel with one or more display pixels. As described above, the electronic display 12 may control light emission from the display pixels to present visual representations of information, such as a graphical user interface (GUI) of an operating system, an application interface, a still image, or video content, by displaying image frames based at least in part on corresponding image data. As depicted, the electronic display 12 is operably coupled to the processor core complex 18 and the image processing circuitry 27. In this manner, the electronic display 12 may display image frames based at least in part on image data generated by the processor core complex 18 and/or the image processing circuitry 27. Additionally or alternatively, the electronic display 12 may display image frames based at least in part on image data received via the network interface 24, an input device, and/or an I/O port 16.

Figure 2:
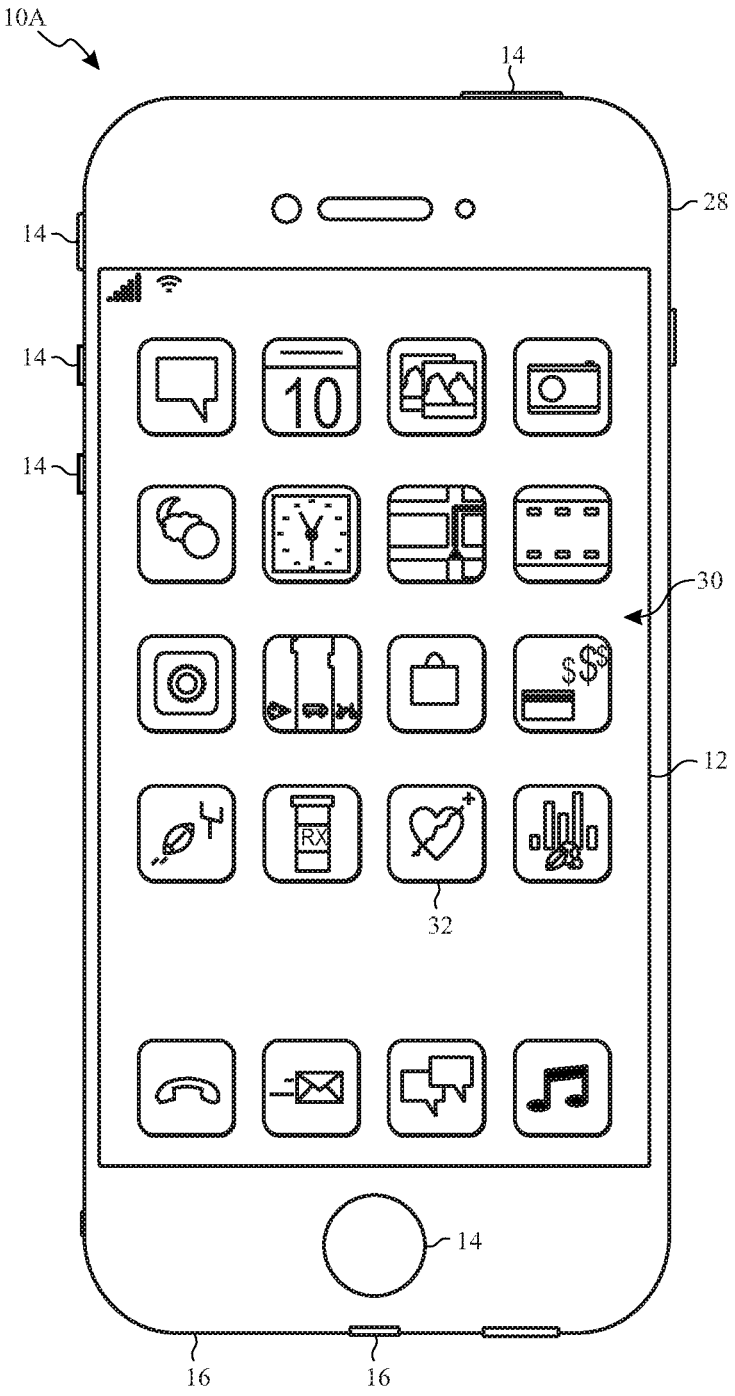
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For illustrative purposes, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 may surround the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 may be accessed through openings in the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 may be accessed through openings in the enclosure 28. In some embodiments, the I/O ports 16 may include, for example, an audio jack to connect to external devices.

Figure 3:
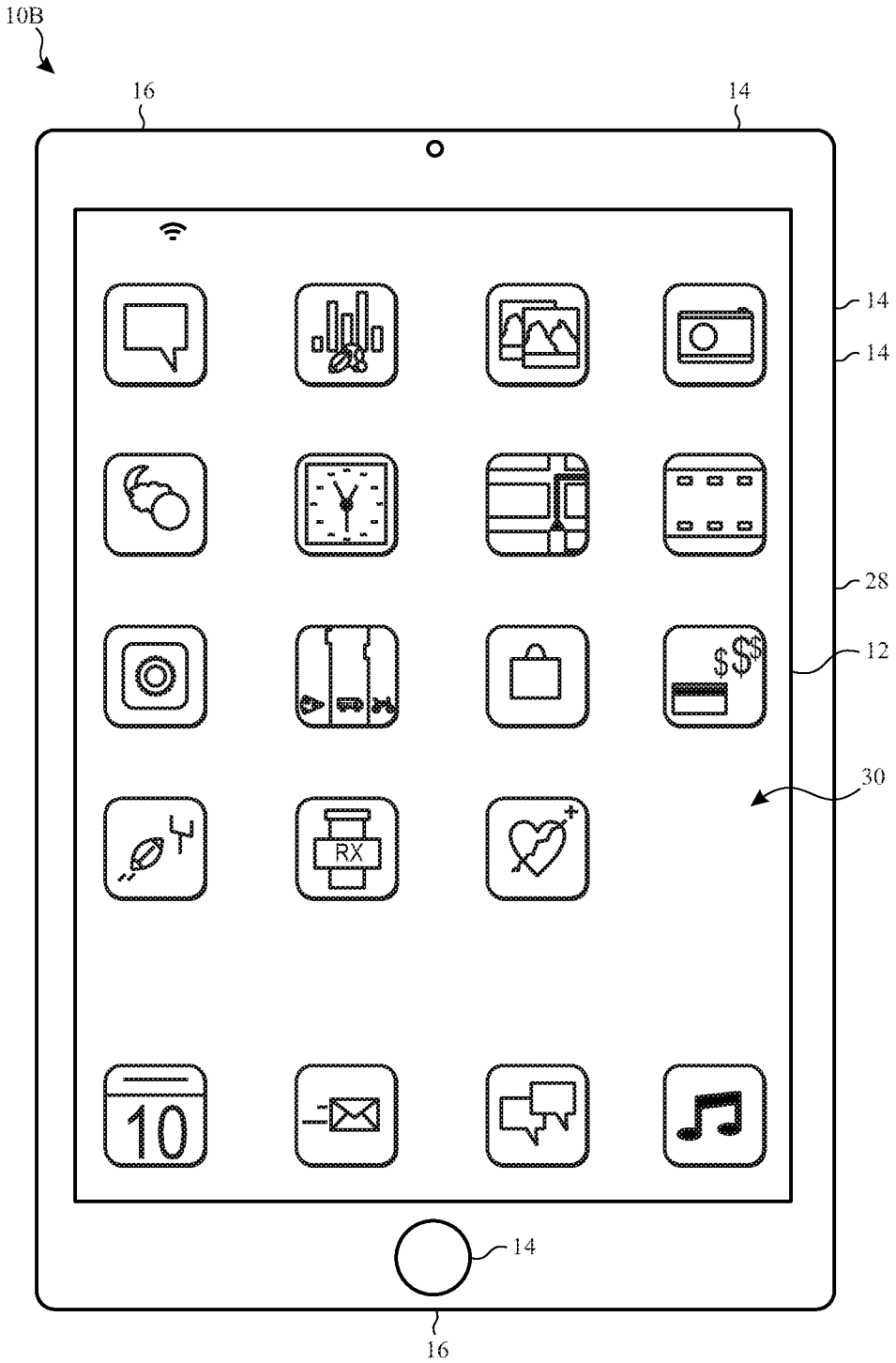
FIG. 3 is another example of the electronic device of FIG. 1, in accordance with an embodiment.
Figure 4:
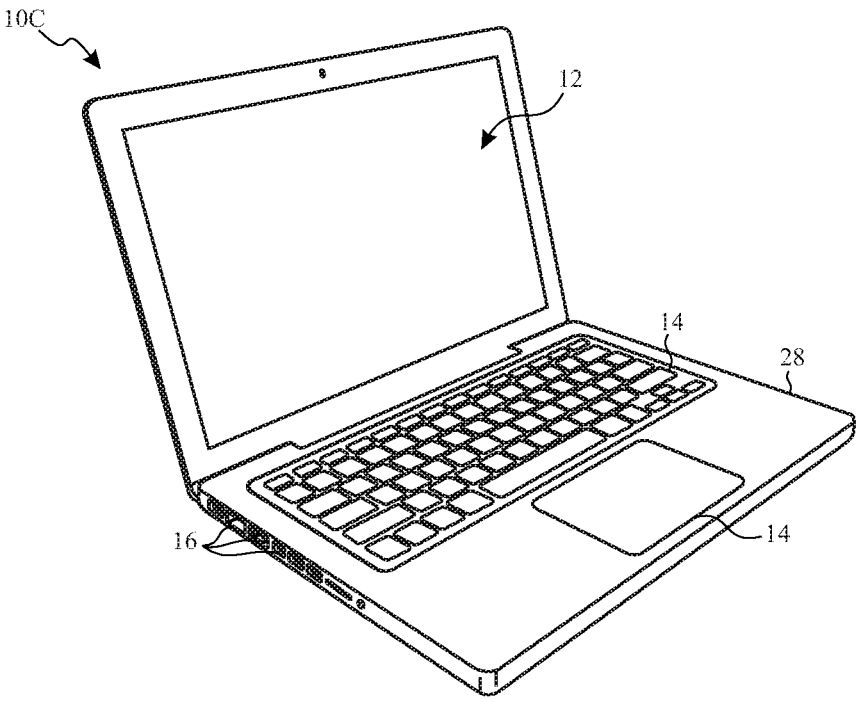
FIG. 4 is another example of the electronic device of FIG. 1, in accordance with an embodiment.
Figure 5:
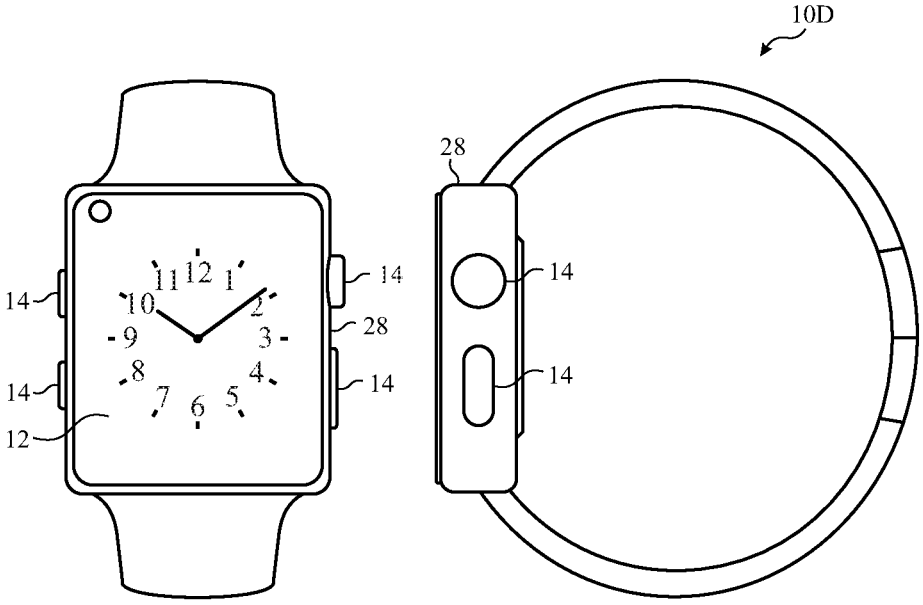
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any Macbook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

In any case, as described above, operating an electronic device 10 to communicate information by display images on its electronic display 12 may include processing image data via a display pipeline before a target presentation time of the corresponding image frame. A display pipeline may include one or more processing circuits and may be implemented in any suitable portion of an electronic device 10, such as in the processor core complex 18 or the image processing circuitry 27, with one or more other processing units or circuitry, or any combination thereof.

The electronic device 10 may store image data corresponding to an image to be displayed at a particular presentation time. Images may originate based at least in part on environmental (e.g., temperature and/or ambient light) changes, actively rendered images for display, queued images for display, and/or the like. Images originating due to environmental changes may be issued to a display pipeline as new images and processed by the display pipeline using a pipeline configuration determined based at least in part on the environmental conditions. In this way, new image data is transmitted from the display pipeline to an electronic display 12 for display but may have the same base image as a previous image displayed on the electronic display 12. In other words, the image is repeated but the image data is new (e.g., image data may change to reflect differences in brightness levels of the surrounding environment to the electronic device) permitting an adjustment to a perceived appearance of the image as displayed on the electronic display 12. Furthermore, images originating from actively rendered images for display and/or queued images for display may also issue as new images to a display pipeline as new image data. Images originating from actively rendered and/or queued images for display may correspond to new image data and new pipeline configurations, and may be any new image dissimilar or similar to the previously displayed image.

In some embodiments, the electronic display 12 performs self-refreshing operations at predetermined intervals or after an image is displayed for a predefined duration. When the electronic display 12 refreshes, image data of the image is displayed again, or repeated, on the electronic display 12. In this way, the image data does not change and is refreshed to adjust voltages associated with a panel of the electronic display 12 to improve perceived appearances of the image. In some instances, a self-refresh of the electronic display 12 may delay presentation of a new image. To reduce likelihood of this occurring, a display pipeline may use a frame pre-notification signal to communicate to the electronic display 12 that a new image for display is incoming. Upon receiving the frame pre-notification signal, the electronic display 12, may halt initiation of a self-refresh at least until after the new image is written.

Figure 6:
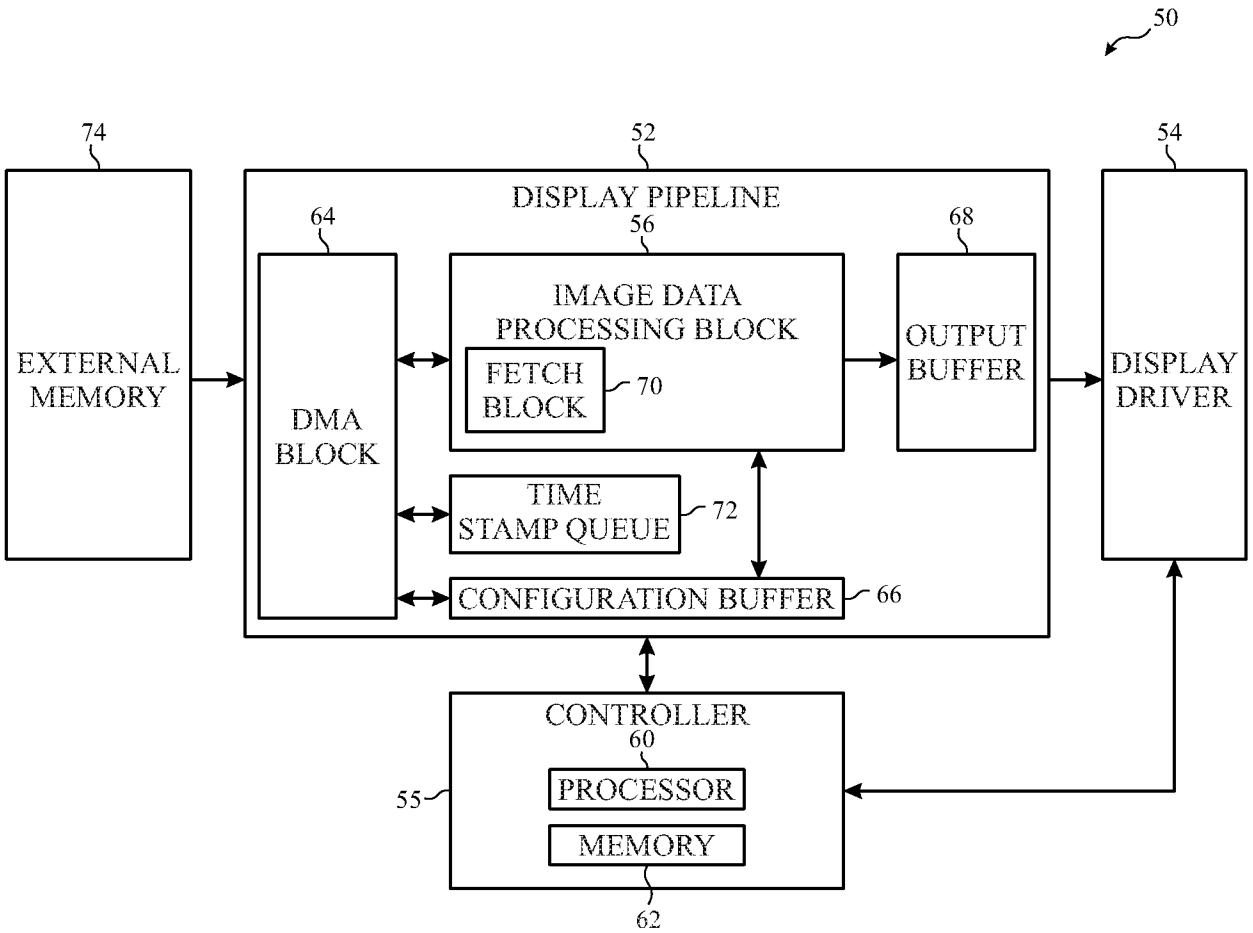
FIG. 6 is a block diagram of a display pipeline of the electronic device of FIG. 1, in accordance with an embodiment.

To help illustrate, an image processing system 50 that includes a display pipeline 52 is shown in FIG. 6. As depicted, the image processing system 50 also includes external memory 74 (e.g., memory 20), a controller 55, and a display driver 54, which may be implemented in an electronic display 12. In some embodiments, the controller 55 may control operations of the display pipeline 52, the external memory 74, the display driver 54, and/or other portions of the electronic device 10.

To facilitate the controlling operation, the controller 55 may include a controller processor 60 and controller memory 62. In some embodiments, the controller processor 60 may execute instructions stored in the controller memory 62. Thus, in some embodiments, the controller processor 60 may be included in the processor core complex 18, the image processing circuitry 27, a timing controller in the electronic display 12, a separate processing module, or any combination thereof. Additionally, in some embodiments, the controller memory 62 may be included in local memory 20, the main memory storage device 22, external memory 74, internal memory of a display pipeline 52, a separate tangible, non-transitory, computer readable medium, or any combination thereof. Although depicted as a single controller 55, in some embodiments, one or more separate controllers 55 may be implemented to control operation of the electronic device.

In any case, the display pipeline 52 may operate to process image data retrieved (e.g., fetched) from the external memory 74, for example, to facilitate improving perceived image quality through the processing. In some embodiments, the display pipeline 52 may be implemented via circuitry, for example, packaged as a system-on-chip (SoC). Additionally or alternatively, the display pipeline 52 may be included in the processor core complex 18, the image processing circuitry 27, a timing controller (TCON) in the electronic display 12, other one or more processing units, other processing circuitry, or any combination thereof.

As depicted, the display pipeline 52 may include a direct memory access (DMA) block 64, a configuration buffer 66, an output buffer 68, one or more image data processing blocks 56 (e.g., image data processing circuitry) including a fetch block 70, and a time stamp queue 72. It should be appreciated that the depicted embodiment is merely intended to be illustrative and not limiting. For instance, in some embodiments, the display pipeline 52 includes the controller 55. In any case, in preparing to display an image frame, in some embodiments, the display pipeline 52 may access the time stamp queue 72, which includes one or more time stamp queue entries each associated with an image (e.g., image frame). Additionally, in some embodiments, a time stamp queue entry may include a pointer to pipeline configuration data to be used to program the display pipeline 52 for processing a corresponding image and a time stamp that indicates target presentation time of the corresponding image.

Figure 7:
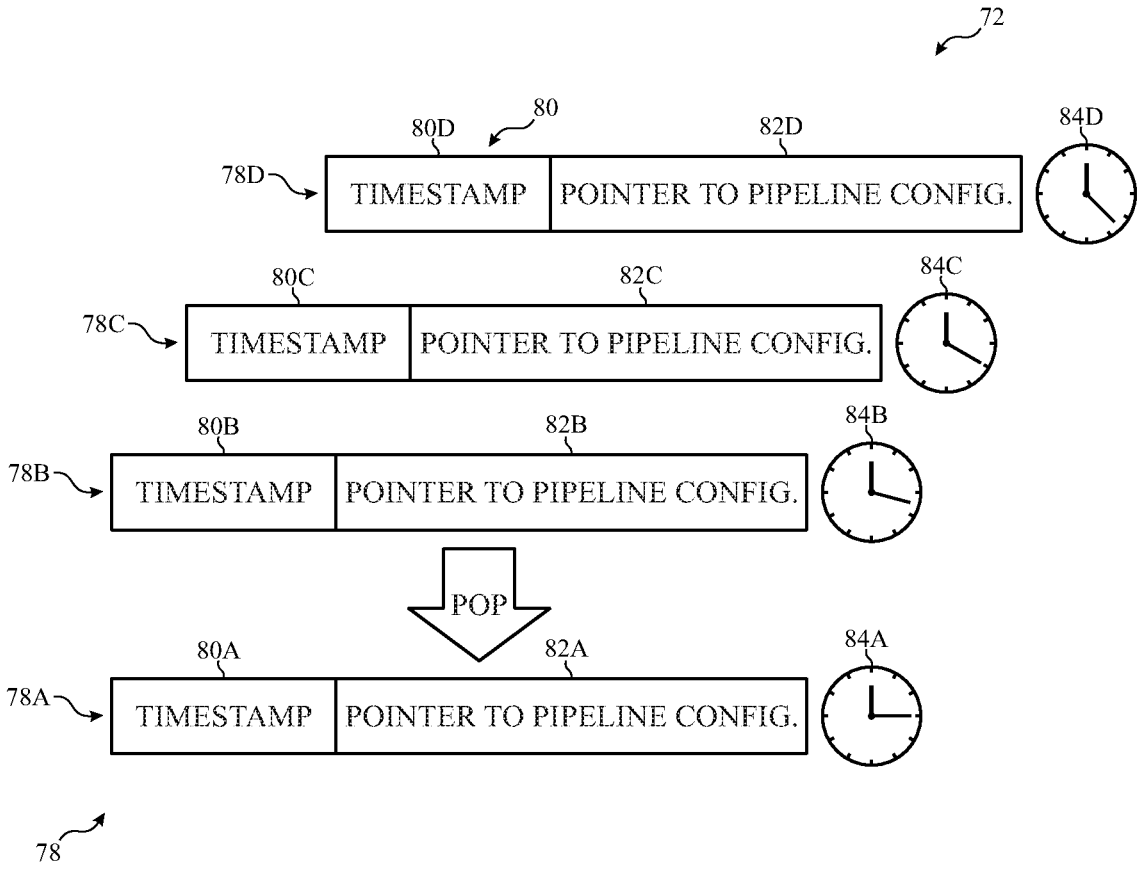
FIG. 7 is a diagrammatic representation of a time stamp queue corresponding with image frames to be displayed on the electronic display of FIG. 1, in accordance with an embodiment.

To help illustrate, an example of a time stamp queue 72 having one or more entries 78 (e.g., entry 78A, entry 78B, entry 78C, entry 78D) is shown in FIG. 7. As depicted, each entry 78 includes a time stamp 80 (e.g., time stamp 80A, time stamp 80B, time stamp 80C, time stamp 80D), and a pointer 82 (pointer 82A, pointer 82B, pointer 82C, pointer 82D). The entries 78 of the time stamp queue 72 each correspond to a different image frame 84. In other words, an image frame 84 may be associated with a time stamp 80, which indicates a target presentation time for the image frame 84, and a pointer 82, which indicates where pipeline configurations for processing image data corresponding with the image frame 84 are stored, for example, in an external memory 74.

A display pipeline 52 may "pop" respective entries 78 from the time stamp queue 72 for processing a sufficient time prior to the target presentation time indicated by the time stamp 80. In the depicted embodiment, entry 78A has been popped for processing by the display pipeline 52 at a sufficient time prior to the time stamp 80A. Upon being popped for processing, the display pipeline 52 may reference the pointer 82A, retrieve the corresponding pipeline configuration, for example, from an external memory 74, and use the retrieved pipeline configuration to prepare itself to process image data associated with the image frame 84A.

Returning to FIG. 6, after applying corresponding pipeline configurations for processing of a next image frame 84, the display pipeline 52 may process and complete preparations associated with displaying the image frame prior to the time stamp 80. The display pipeline 52 may use an image data processing block 56 to prepare the image data for transmission to the display driver 54. Upon completion of processing, the display pipeline 52 may transmit the image data to the display driver 54 to enable display of the corresponding image frame 84 on the electronic display 12.

Based at least in part on image data transmitted by the display pipeline 52, the display driver 54 may generate and supply analog electrical signals to display pixels of the electronic display 12 to display an image frame. Furthermore, the display driver 54 may refresh the electronic display 12 according to various, predetermined refresh frequencies (e.g., 60 Hz, 50 Hz, 40 Hz, 30 Hz, 20 Hz, 10 Hz) to reduce an appearance of visual artifacts on the electronic display 12. In some embodiments, the display driver 54 may refresh the electronic display 12 after an image has been displayed for a predetermined duration, for example, through comparing a duration of display against a threshold value stored in memory such as external memory 74 to determine if an image has been displayed for the predetermined duration indicated by the threshold value.

In some instances, an electronic device 10 may include one or more processing pipelines (e.g., a display pipeline 52). To facilitate communication therebetween, the one or more processing pipelines may include a DMA block 64. In particular, the DMA block 64 may read (e.g., retrieve) image data from the external memory 74 and/or write (e.g., store) image data to the external memory 74. Additionally or alternatively, the DMA block 64 may retrieve pipeline configurations to program (e.g., configure) registers in the display pipeline 52 from the external memory 74 based on the pointers 82, for example, into a configuration buffer 66 (e.g., a shadow first-in first-out (FIFO)) to program registers (e.g., a set of programmable registers from multiple sets of programmable registers) in the display pipeline 52 before processing of the image data. After processing using a pipeline configuration, in some embodiments, the display pipeline 52 may store image data in an output buffer 68 before outputting the image data to the display driver 54.

In some embodiments, image data retrieved from the external memory 74 may be processed in the image data processing block 56 to improve a perceived image quality when the image data is used to display a corresponding image. For example, the image data processing blocks 56 may include a color management block that converts image data from a source space to a display space of the electronic display 12. Additionally or alternatively, the image data processing blocks 56 may include a pixel contrast control block that applies tone maps to the image data to control perceived contrast based at least in part on environmental conditions, such as ambient light. Furthermore, the image data processing blocks 56 may include a fetch block 70 that uses the DMA block 64 to retrieve image data for processing. Additionally or alternatively, the display pipeline 52 may use the DMA block 64 to retrieve pipeline configurations from external memory 74, for example, based on pointers 82 popped from the time stamp queue 72.

The image processing system 50, using the devices described, may operate in one of two operational modes. A first operational mode may be a normal mode, where the image processing system 50 operates the electronic display 12 to refresh at a constant refresh rate (e.g., 60 Hz, 50 Hz, 40 Hz, 30 Hz, 20 Hz, 10 Hz, etc.). While operating in the normal mode, a display driver 54 may output a self-refresh frame at a predictable frequency and the image processing system 50 may base when to output a new image data to the display driver 54 on the predictable frequency associated with the output of the refreshed image data. However, a second operational mode may be a variable refresh rate mode, where the display driver 54 may output refreshed image data at a frequency that varies, for example, with a content of an image frame (e.g., slow moving content versus fast moving content). While operating in the variable refresh rate mode, the image processing system 50 may utilize a frame pre-notification signal to halt, or delay, the display driver 54 from self-refreshing when new image data is about to output to the display driver 54.

Additionally, while operating in the variable refresh rate mode, the display pipeline 52 may assume a next potential presentation time based on a minimum display duration (e.g., 60 Hz frame duration) and may perform checks for images and/or indications associated with images at times related and prior to the next potential presentation time. The display pipeline 52 uses the minimum display duration because new images may be shown on an electronic display 12 as fast as the display pipeline 52 prepares and processes new image for display—thus, the minimum display duration is indicative of the minimum amount of time a display pipeline 52 uses to prepare before, during, and after a display of a new image. In this disclosure, as an example, the minimum display duration is taken to be about 16 ms or a duration of four sub-frames (e.g., 240 Hz, one quarter of a 60 Hz frame duration) corresponding to a refresh rate of 60 Hz, meaning that a new image is not permitted to be displayed until at least 16 ms after the presentation time of a directly previous image.

Figure 8:
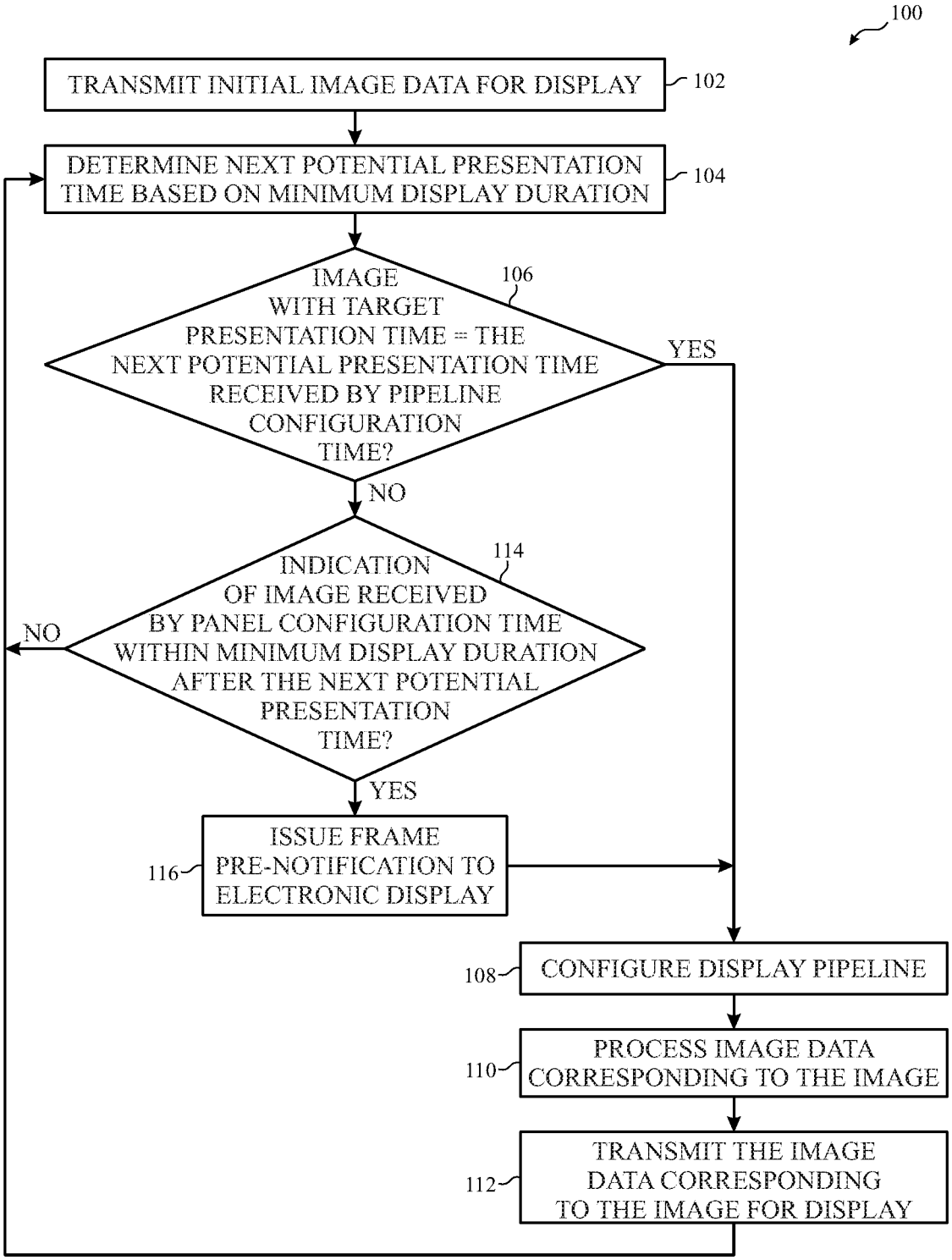
FIG. 8 is flowchart of a process for operating the display pipeline of FIG. 6, in accordance with an embodiment.

To help illustrate, an example of a process 100 for controlling operation of a display pipeline 52 coupled to an electronic display 12 is described in FIG. 8. Generally the process 100 includes transmitting initial image data to an electronic display (process block 102), determining a next potential presentation time based on a minimum display duration (process block 104), determining if an image having a target presentation time equal to the next potential presentation time is received by a pipeline configuration time (decision block 106). When the image is received, the process 100 includes configuring a display pipeline (process block 108), processing image data corresponding to the image (process block 110), and transmitting the image data corresponding to the image for display (process block 112). When the image is not received, the process 100 includes determining if an indication of an image is received by a panel configuration time within the minimum display duration after the next potential presentation time (decision block 114). When the indication of the image is received, the process 100 includes issuing a frame pre-notification signal to an electronic display (process block 116), continuing on to configure a display pipeline (process block 108), and so forth. When the indication of the image is not received, the process 100 includes repeating the determination of a next potential presentation time based on a minimum display duration (process block 104). In some embodiments, the process 100 may be implemented by executing instructions stored in a tangible, non-transitory, computer-readable medium, such as external memory 74, using processing circuitry, such as the display pipeline 52 and/or a controller 55.

Thus, in some embodiments, the display pipeline 52 may transmit image data corresponding to an initial image for display (process block 102). The display pipeline 52 may have previously popped an entry 78 from the time stamp queue 72 and retrieved pipeline configurations at the location indicated by a pointer 82, for example, from the external memory 74 into the configuration buffer 66. Upon configuring itself based upon the retrieved pipeline configurations, the display pipeline 52 processes the image data and transmits the image data to a display driver 54 for display at the presentation time indicated by a time stamp 80.

Upon transmitting the image data for display, the display pipeline 52 may determine a next potential presentation time based on a minimum display duration (process block 104). The minimum display duration is a duration of time corresponding to an absolute soonest time that a next image is potentially able to be displayed. For example, in some embodiments, the minimum display duration corresponds to a minimum time period associated with preparatory actions of displaying an image, including preparing a display pipeline 52 for processing and transmission of image data and displaying the image data on an electronic display 12. This minimum time period, in some instances, corresponds to a quickest acceptable refresh rate, for example, 60 Hz, where if new image data were to be driven to an electronic display 12 at the quickest acceptable refresh rate, the display system 50 has the time to complete the preparatory actions. Thus, the display pipeline 52 determines the next potential presentation time to be the next potential presentation time based at least in part on the minimum display duration.

Figure 9:
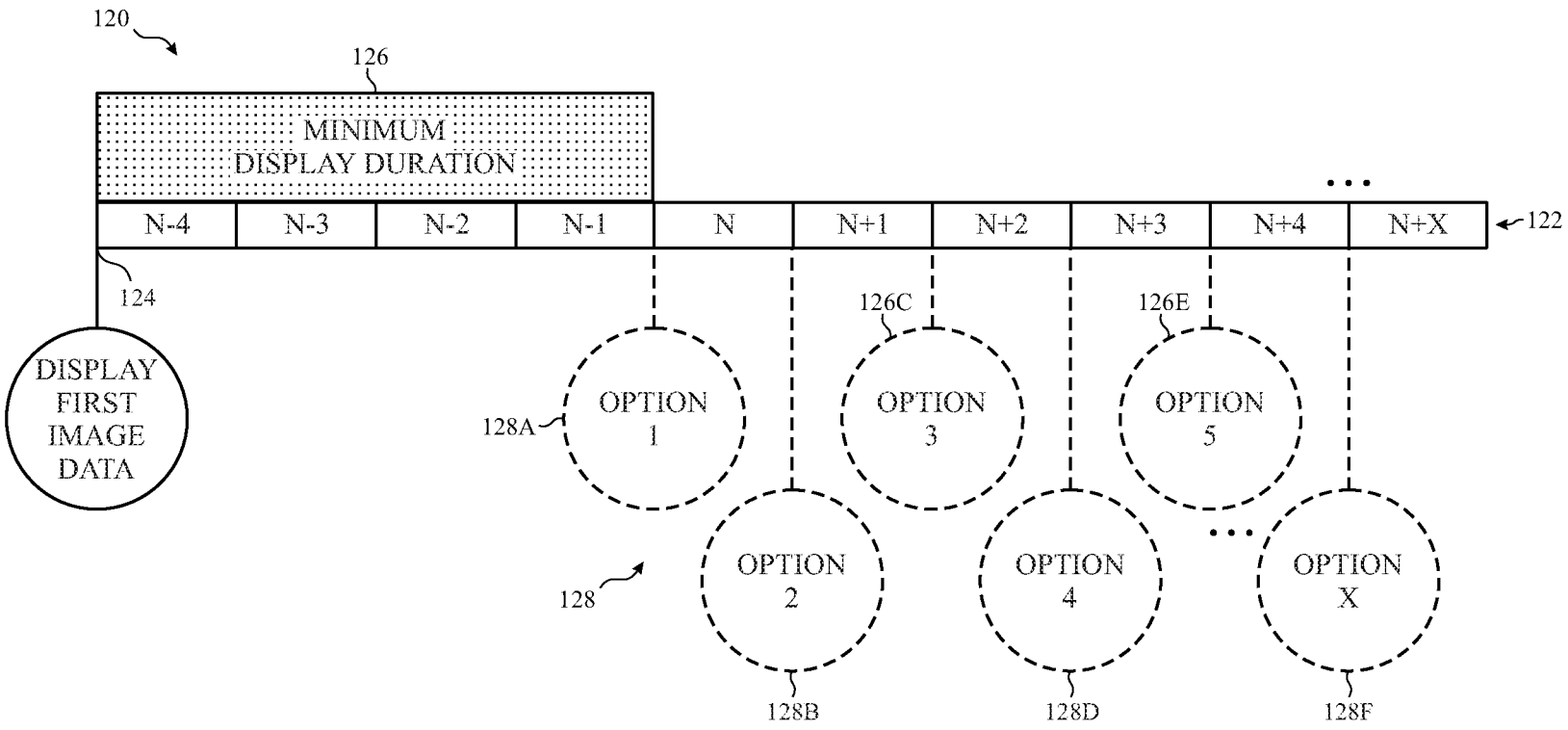
FIG. 9 is a diagrammatic representation of potential presentation times corresponding to the process of FIG. 8, in accordance with an embodiment.

To help illustrate, a diagrammatic representation of next potential presentation times, a timeline 120 of sub-frames 122 showing a presentation time 124, minimum display duration 126, and one or more options 128 for a next potential presentation time are shown in FIG. 9. It should be appreciated that the depicted diagrammatic representation of next potential presentation times is merely intended to be illustrative, not limiting. For example, in some embodiments, a minimum display duration 126 may be less than or greater than four sub-frames 122.

As depicted, a minimum display duration 126 corresponds to four sub-frames 122 or three sub-frame 122 boundaries. Sub-frames 122 may represent any duration of time, and are configurable between embodiments of the electronic device 10. For example, an electronic display 12 may have a minimum refresh rate of 60 Hz, thus the minimum display duration 126 equals approximately 16 ms where each sub-frames 122 equals approximately 4 ms. If no image is to be displayed at presentation time option 128A, the next potential presentation time is option 128B, which is one sub-frame 122 (e.g., 4 ms) later than the option 128A. If no image is to be displayed at the option 128B, the next potential presentation time is option 128C, which is one sub-frame 122 (e.g., 4 ms) later than the option 128B and two sub-frames 122 (e.g., 8 ms) later than the option 128A. As is depicted, the options 128 for the next potential presentation time continue as long as permitted, for example, software restrictions may limit a number of options 128. Thus, a next potential presentation time may be longer than or equal to a minimum display duration plus the presentation time 124. In the event that an image is to be displayed at a next potential presentation time, the available options 128 change.

Figure 10:
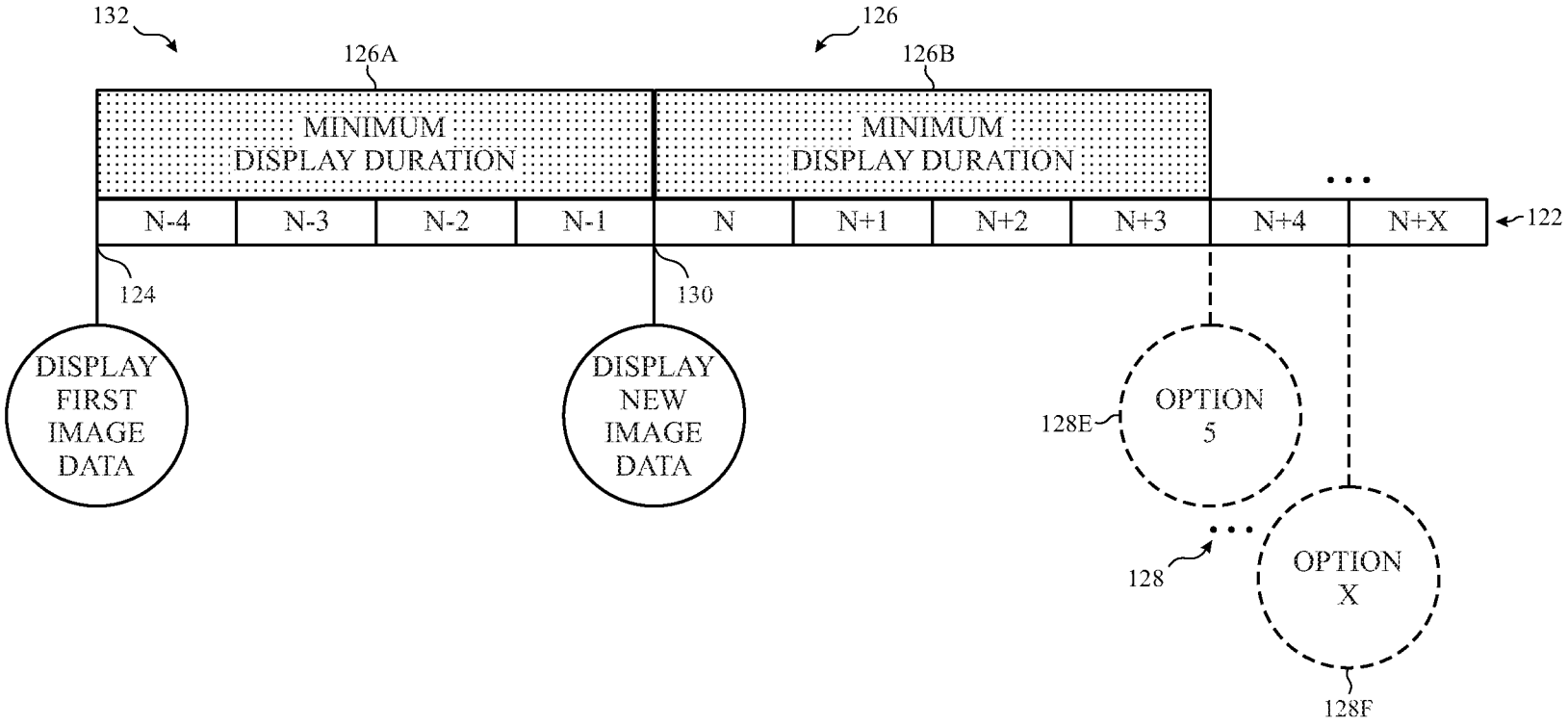
FIG. 10 is a diagrammatic representation of potential presentation times corresponding to the process of FIG. 8, in accordance with an embodiment.

To help illustrate, a diagrammatic representation of next potential presentation times when a second image is to be displayed at a next potential presentation time, a timeline 132 of sub-frames 122 showing a presentation time 124, a next potential presentation time 130, minimum display durations 126, and one or more options 128 for a next potential presentation time is shown in FIG. 10. It should be appreciated that the depicted diagrammatic representation of next potential presentation times is merely intended to be illustrative and not limiting. For example, in some embodiments, a minimum display duration 126 may be less than or greater than four sub-frames 122.

As depicted, a minimum display duration 126 corresponds to four sub-frames 122 or three sub-frame 122 boundaries. As described earlier, sub-frames 122 may represent any duration of time, and are configurable between embodiments of the electronic device 10. In this example, an image was displayed at the presentation time 124 and a second image is to be displayed at the next potential presentation time 130, where the first image is different from the second image (e.g., the second image corresponds to new image data). In cases like this, due to the minimum display duration, the next potential presentation time after the presentation time 130 is option 128E because a new image displays at least a minimum display duration past a presentation time of an image. Comparing FIG. 9 to FIG. 10, option 128B, option 128C, and option 128D are not considered as next potential presentation time options 128 because they occur during a minimum display duration, and thus are not able to be a next potential presentation time.

Returning to the process 100 of FIG. 8, using the next potential presentation time, the display pipeline 52 may determine if an image having a target presentation time equal to the next potential presentation time is received by a pipeline configuration time (decision block 106). The pipeline configuration time occurs a duration before the next potential presentation time to enable enough time for display pipeline 52 to apply pipeline configurations. The duration may equal a period of time to prepare the display pipeline 52 to process image data, for example, enough time to retrieve and apply pipeline configurations to the display pipeline 52, enough time to load the pipeline configuration, and/or enough time perform adjustments to image data prior to output for display. In this way, if the image is received, enough time exists to prepare corresponding image data for display without causing delay relative to its target presentation time.

When an image having a target presentation time equal to the next potential presentation time is received by the pipeline configuration time, a display pipeline 52 configures itself to prepare for processing image data corresponding to the image (process block 108). Additionally or alternatively, a controller 55 may operate to prepare the display pipeline 52 for processing image data and/or may apply one or more pipeline configurations to the display pipeline 52. The display pipeline 52 may be programmed with a pipeline configuration, for example, retrieved from a location indicated by a pointer 82 into the configuration buffer 66 and stored from the configuration buffer 66 into programmable registers (e.g., a set of programmable registers from multiple sets of programmable registers) of the image data processing blocks 56. The pipeline configuration may change settings of the display pipeline, for example, to change dimensions of the image data, orientations of image data, content and/or color of image data, temperature values of image data, brightness of image data, and the like based on detected and/or measured values of dimensions, orientations, content, color, temperature, brightness, and the like, such that the pipeline configuration adjusts an appropriate amount for a status quo of the setting.

After pipeline configurations are programmed, the display pipeline 52 may process the image data corresponding to the received image (e.g., the image having a target presentation time equal to the next potential presentation time received by the pipeline configuration time) (process block 110). In some embodiments, processing the image data may enable corrections due to environmental and/or operating changes. For example, in response to a brighter environment (e.g., walking outdoors from an indoor room), a display pipeline 52 may program itself with a pipeline configuration including instructions to process image data to counteract and/or compensate for the brighter environment by, in some instances, increasing a perceived brightness of the electronic display 12 through the processing of the image data.

After the image data is processed, the display pipeline 52 may transmit the image data corresponding to the image for display (process block 112). As described earlier, the display pipeline 52 transmits image data for display to a display driver 54. The display driver 54 enables display of the image through transmission of image data and/or associated electrical signals to one or more display pixels of an electronic display 12 to show the image.

However, when an image having a target presentation time equal to the next potential presentation time is not received by the pipeline configuration time (decision block 106), the display pipeline 52 performs an additional check to determine if an indication of an image is received by a panel configuration time within a minimum display duration after the next potential presentation time (decision block 114). An indication of an image may be a signal, a flag, a notification, and/or the like transmitted to the display pipeline 52 to communicate to the display pipeline 52 an upcoming image to be displayed. The display pipeline 52 may determine if the indication of an image is received by a panel configuration time, where the image is to be displayed at a time within a minimum display duration immediately following the next potential presentation time. In this way, the display pipeline 52 determines if an image is to be displayed during a period of time that may be affected by a self-refresh of an electronic display 12, which occurs at the next potential presentation time (e.g., during the minimum display duration following a next potential presentation time). That is, an image having a target presentation time that occurs between a first potential presentation time based on a previous image to be displayed and a second potential presentation time based on the maximum refresh rate (e.g., a maximum refresh rate duration after the first potential presentation time) may be affected by a self-refresh of the electronic display 12.

If an indication of an image is not received, meaning that an image is not to be displayed during the period of time affected by a potential self-refresh of an electronic display 12 following the next potential presentation time, the display pipeline 52 may determine a next potential presentation time based on the minimum display duration and continues to repeat the process 100 (process block 104). This is the same technique as previously described, except this time, the next potential presentation time is advanced at least one sub-frame. For example, referring back to FIG. 9, if a next potential presentation time was option 128A, after determining that an image is not to be displayed during the period of time affected by a potential self-refresh of an electronic display 12 following the option 128A, the next potential presentation time is update to option 128B. Upon the display duration of the current image exceeding a minimum display duration, a next potential presentation time may occur at any time in line with configurations of the display pipeline 52, for example, aligned with sub-frame 122 boundaries.

Returning to FIG. 8, if an indication of an image is received, meaning that an image is to be displayed in the period of time that may be affected by a self-refresh of an electronic display 12 following the next potential presentation time, the display pipeline 52 transmits a frame pre-notification signal to the electronic display 12 (process block 116). The frame pre-notification signal acts to alert the electronic display 12 of the incoming new image data. In response to the frame pre-notification signal, the electronic display 12 may perform an action, for example, temporarily halting initiation of self-refreshes so as not to interrupt and/or damage the transmission of new image data for display. The process 100 continues as previously described after the transmission of the frame pre-notification signal, and in this way, upon receiving the new image data, the display pipeline 52 configures itself for processing of the new image data (process block 108), processes the new image data (process block 110), and transmits the new image data for display (process block 112) to the electronic display 12.

Figure 11:
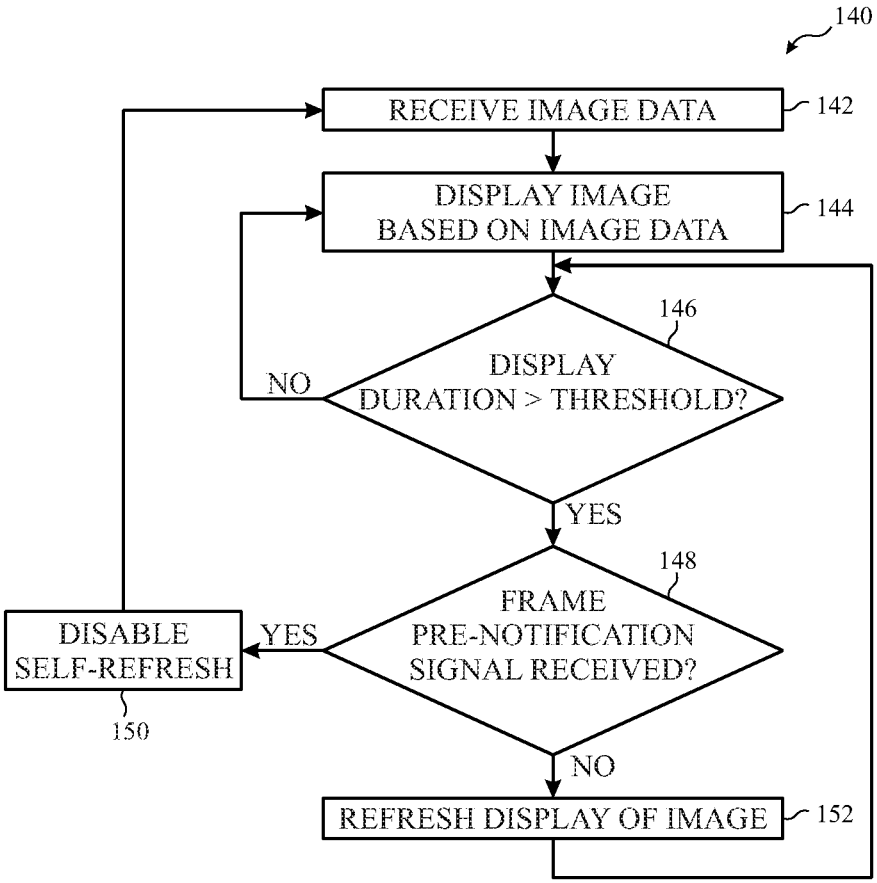
FIG. 11 is a flowchart of a process for operating the electronic display associated with the display pipeline of FIG. 6, in accordance with an embodiment.

To better illustrate an example response of an electronic display 12 to a frame pre-notification signal, a process 140 for controlling operation of an electronic display 12 coupled to a display pipeline 52 is described in FIG. 11. Generally the process 140 includes receiving image data (process block 142), displaying image based on image data (process block 144), and determining whether display duration of the image is greater than a threshold (decision block 146). When the display duration is greater than the threshold, the process 140 includes determining if a frame pre-notification signal is received (decision block 148), disabling self-refresh when a frame-pre notification signal is received (process block 150), and refreshing display of the image when a frame pre-notification signal is not received (process block 152). In some embodiments, the process 140 may be implemented by executing instructions stored in a tangible, non-transitory, computer-readable medium, such as external memory 74, using processing circuitry, such as the display pipeline 52 and/or a controller 55.

Thus, in some embodiments, the electronic display 12 may receive image data (process block 142). The electronic display 12 receives image data from a display pipeline 52 to an associated display driver 54. Various electrical signals may generate in response to the image data and may be used to drive display pixels to display an image corresponding to the image data.

After receiving the image data, the electronic display 12 may display an image based on the image data (process block 144). The displayed image corresponds to the image data. The various electrical signals created in response to the image data may be used to display (e.g., write) an image on the electronic display 12 corresponding to the image data. The image is created through the various electrical signal interaction with light-emitting portions of display pixels of the electronic display 12.

While the image is displayed, the electronic display 12 may determine whether a display duration of the image is greater than a threshold (decision block 146). Light-emitting portions of the electronic display 12 may have properties that change as electrical signals are applied over time. To compensate for changes, the electronic display 12 may track a display duration of any given image displayed. This display duration may be compared against a threshold to indicate a duration of displaying that may permit a refresh of the electronic display 12. The threshold may be stored in the electronic device 10 in any suitable memory, such as, external memory 74 or memory 20.

When the display duration does not exceed a threshold of the electronic display 12, the electronic display 12 may continue to display an image based on the image data (process block 144). The electronic display may increment a counter used to track a display duration, or may track the total length of time displayed in a variety of other manners. In doing so, the electronic display 12 waits to self-refresh until the display duration is large enough to exceed the threshold. On the other hand, when the display duration exceeds the threshold, the electronic display 12 may determine if a frame pre-notification signal has been received (decision block 148). As described above, the frame pre-notification signal may be transmit from a display pipeline 52 to an electronic display 12 to perform an action, such as halting a self-refresh to decrease a chance of the self-refresh altering and/or interrupting new image data transmitted to the electronic display 12.

When the frame pre-notification signal has not been received, the electronic display 12 may refresh display of the image (process block 152). To refresh display of the image, an electronic display may transmit the same image data to light-emitting portions of the electronic display 12 as a way to "refresh" an appearance of the image and restart electrical signals applied to the light-emitting portions of the electronic display 12. Upon refreshing of the image, the electronic display 12 may restart tracking of the display duration and determines once more if a display duration of the image exceeds a threshold (decision block 146).

When the frame pre-notification signal has been received, the electronic display 12 may disable self-refresh (process block 150). In disabling self-refresh, the electronic display 12 does not permit refreshing of the image. This enables new image data to transmit from the display pipeline 52 without being interrupted by refreshed image data associated with a self-refresh. Upon disabling self-refresh, the electronic display 12 may receive the new image data transmitted from the display pipeline 52 and repeat the process 140 (process block 142). Thus, process 100 and the process 140 illustrate how a display pipeline 52 works to manage self-refreshing of an electronic display 12. These processes described rely on an indication of an image to be displayed.

Figure 12:
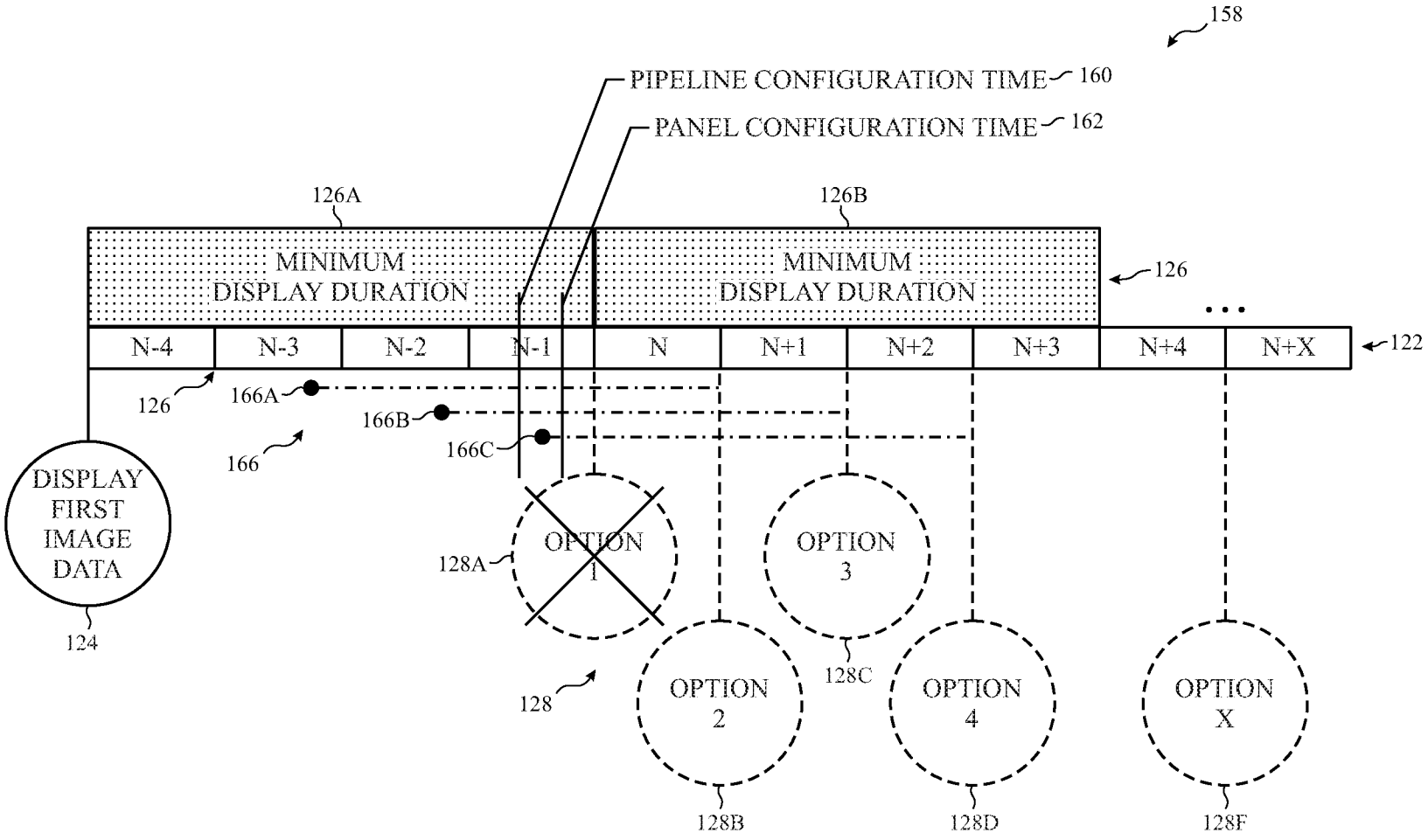
FIG. 12 is a diagrammatic representation of potential presentation times and indications of images corresponding to the process of FIG. 8 and the process of FIG. 11, in accordance with an embodiment.

To help further illustrate, a diagrammatic representation of indications of images including a timeline 158 of sub-frames 122 having a presentation time 124, minimum display durations 126, indications 166, one or more options 128 for a next potential presentation time, a pipeline configuration time 160, and a panel configuration time 162 is shown in FIG. 12. It should be appreciated that the depicted diagrammatic representation is merely intended to be illustrative, not limiting. For example, in some embodiments, a minimum display duration 126 may be less than or greater than four sub-frames 122.

In the illustrated scenario, a display pipeline 52 processed and transmitted image data for display of a first image at the presentation time 124. Following the process 100, the display pipeline 52 determines the next potential presentation time as option 128A because option 128A occurs a minimum display duration 126A after the display of the first image at the presentation time 124. Continuing with the process 100, the display pipeline 52 checks if a new image was received by the pipeline configuration time 160 (e.g., a defined duration before the next potential presentation time of option 128A) and determined that no new image was received by the pipeline configuration time 160. As shown through the cross-out, "X," of option 128A, the next potential presentation time is no longer option 128A because if a new image is to be displayed at the time represented by a respective option of the options 128, the display pipeline 52 should receive the new image before the pipeline configuration time 160 of the respective option to provide sufficient for time for processing.

The display pipeline 52, after determining that no new image was received by the pipeline configuration time 160, checks if an indication of an image to be displayed within the minimum display duration 126B was received. The minimum display duration 126B represents a minimum display during after the option 128A for the next potential presentation time. Because there is not an image to display at the option 128A, the electronic display 12 may perform a self-refresh. If the electronic display 12 performs a self-refresh at the same time as a new image is prepared for display during the minimum display duration 126B, the presentation time of the new image may be delayed, and thus may be displayed at a time later than the target presentation time indicated by time stamps 80. As such, the display pipeline 52 checks if an indication of an image to be displayed within the minimum display duration 126B was received.

The potential images to be displayed during the minimum display duration 126B may have a presentation time corresponding to option 128B, option 128C, or option 128D. Each potential image having a presentation time equal to either option 128B, option 128C, or option 128D may correspond to an indication 166A, an indication 166B, or an indication 166C that is received by the display pipeline 52 a predefined duration before the target presentation time. In the depicted embodiment, the predefined duration corresponds to a duration between three to four sub-frames 122 before the target presentation time. For example, the time represented by the indication 166A corresponds to the time at which an indication is received by the display pipeline 52 when said indication corresponds to an image having a presentation time equal to option 128A. It should be appreciated that, while the indications 166 are depicted as visual representations of a time corresponding to option 128B, option 128C, or option 128D, the indications may be signals, flags, bits, or an otherwise communicated signal transmitted to the display pipeline 52 at the time indicated by the indications 166 to alert the display pipeline 52 of an incoming image.

If either indication 166A, indication 166B, and/or indication 166C is received by the display pipeline 52 prior to the panel configuration time 162, the display pipeline 52 transmits a frame pre-notification signal. The frame pre-notification signal may be received by a display driver 54 and/or an electronic display 12 and may cause the performance of an action, such as, disabling self-refreshing operations of the electronic display 12. Similarly, if no indications 166 were received, the actual display duration of the display is longer than the minimum display duration 126A and the display pipeline 52 determines the next potential presentation time to be option 128B. The display pipeline 52 checks again at the corresponding pipeline configuration time for a new image and/or the panel configuration time for an indication of a new image. Furthermore, if no new image and/or no indication of a new image is received, the display pipeline 52 assumes option 128C to be the next potential presentation time and repeats checking at the corresponding pipeline configuration time for a new image and/or the panel configuration time for an indication of a new image. In this way, the display pipeline 52 proceeds through the options 128 until a new image and/or an indication of a new image is received for display.

Additionally or alternatively, in some embodiments, if a display pipeline 52 receives any combination of the indication 166A, the indication 166B, and/or the indication 166C, the display pipeline 52 may decide to disregard one image received based on programmed rules associated with the type of image received and/or a data source of the image (e.g., portion of an electronic device 10 that instructs the display pipeline 52 to process the image). For example, the display pipeline 52 may assign a higher priority, or more importance, to an image from the time stamp queue 72 than an image generated in response to a brightness and/or temperature update. In this way, programmed rules may define when to consolidate brightness and/or temperature updates into a next image for display. For example, if a first new image associated with the brightness and/or temperature update (e.g., the update not corresponding to a time stamp queue 72 entry 78) and a second new image corresponding to a time stamp queue entry 78 are received before a pipeline configuration time 160, the display pipeline 52 may apply at least a part of the pipeline configurations from the first new image to the pipeline configurations for the second new image. In this way, any changes to the brightness and/or temperature in the image displayed on the screen may be applied to a new image about to be displayed without delaying a presentation time of the image to be displayed.

Technical effects of the present disclosure include a display pipeline designed to provide a frame pre-notification signal to alert an electronic display about incoming new image data. In response to the frame pre-notification signal, the electronic display does not self-refresh and reduces a likelihood of collision between image data corresponding to a new image for display and refreshed image frames used in refreshing the electronic display. Following the techniques disclosed herein may improve an appearance of visual artifacts of the electronic display by reducing a likelihood of collision, or interference, between image data transmitted for display.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device, comprising:

a display panel configured to display a first image at a first target presentation time based at least in part on first image data corresponding with the first image; and a display pipeline coupled to the display panel, wherein the display pipeline comprises:

first image data processing circuitry programmed to perform a first operation on second image data corresponding with a second image to be displayed after the first image based at least in part on configuration data stored in a first set of registers; and a controller programmed to:

determine a first presentation time option that occurs after the first target presentation time based at least in part on a maximum refresh rate of the display panel;

determine a second presentation time option based at least in part on the maximum refresh rate and the first presentation time option;

determine whether a second target presentation time of the second image is equal to a time between the first presentation time option and the second presentation time option; and output a first pre-notification signal at a first time that instructs the display panel to pause self-refreshes until after the second image is displayed when the second target presentation time of the second image is equal to the time between the first presentation time option and the second presentation time option, wherein the first pre-notification signal corresponds to the second image and is configured to be issued before the second target presentation time to pause refresh operations of the display panel.

2. The electronic device of claim 1, wherein:

the display pipeline comprises a configuration buffer configured to store first configuration data associated with the second image; and the controller is programmed to instruct the display pipeline to store the first configuration data associated with the second image in the first set of registers of the first image data processing circuitry at a first pipeline configuration time that occurs between the first target presentation time and the first presentation time option when the second target presentation time of the second image is equal to the first presentation time option.

3. The electronic device of claim 1, wherein:

the display pipeline comprises second image data processing circuitry programmed to perform a second operation on the second image data based at least in part on configuration data stored in a second set of registers to facilitate adapting display of the second image based at least in part on brightness of the display panel, temperature of the display panel, or both; and the first image data processing circuitry is programmed to perform the first operation of the second image data based at least in part on configuration data stored in the first set of registers to facilitate adjusting display of the second image based at least in part on dimensions of the second image, dimensions of the display panel, orientation of the second image, orientation of the display panel, content of the second image, or any combination thereof.

4. The electronic device of claim 3, comprising external memory coupled to the display pipeline, wherein the external memory is configured as internal to the electronic device, and wherein:

the external memory is configured to:

store first configuration data associated with a first brightness setting, a first temperature value, or both;

store second configuration data associated with a second brightness setting, a second temperature value, or both; and store third configuration data associated with the second image; and the controller is programmed to:

determine the brightness of the display panel, the temperature of the display panel, or both before a first pipeline configuration time that occurs between the first target presentation time and the first presentation time option; and when the second target presentation time of the second image is equal to the first presentation time option:

instruct the display pipeline to store the third configuration data in the first set of registers of the first image data processing circuitry at the first pipeline configuration time; and instruct the display pipeline to store the first configuration data in the second set of registers of the second image data processing circuitry at the first pipeline configuration time when the second target presentation time of the second image is equal to the first presentation time option and the brightness of the display panel is the first brightness setting, the temperature of the display panel is the first temperature value, or both.

5. The electronic device of claim 4, wherein, when the second target presentation time of the second image is equal to the first presentation time option and the first configuration data is stored in the second set of registers at the first pipeline configuration time, the controller is programmed to:

instruct the display pipeline to begin processing the second image data after the first pipeline configuration time to enable the display pipeline to generate first processed image data used by the display panel to display the second image at the second target presentation time;

determine a third presentation time option that occurs after the second target presentation time based at least in part on the maximum refresh rate of the display panel;

determine the brightness of the display panel, the temperature of the display panel, or both before a second pipeline configuration time that occurs between the second target presentation time and the third presentation time option; and when the brightness of the display panel changes from the first brightness setting to the second brightness setting, the temperature of the display panel changes from the first temperature value to the second temperature value, or both:

instruct the display pipeline to store the third configuration data in the first set of registers of the first image data processing circuitry at the second pipeline configuration time;

instruct the display pipeline to store the second configuration data in the second set of registers of the second image data processing circuitry at the second pipeline configuration time; and instruct the display pipeline to begin processing the second image data after the second pipeline configuration time to enable the display pipeline to generate second processed image data used by the display panel to repeat display of the second image at the third presentation time option.

6. The electronic device of claim 3, comprising external memory coupled to the display pipeline, wherein the external memory is configured as internal to the electronic device, and wherein:

the external memory is configured to:

store first configuration data associated with a first brightness setting, a first temperature value, or both;

store second configuration data associated with a second brightness setting, a second temperature value, or both;

store third configuration data associated with the first image; and store fourth configuration data associated with the second image; and the display pipeline comprises a time stamp queue configured to stored one or more entries that each indicates target presentation time of an associated image and identifies associated configuration data;

the display pipeline is configured to process the first image data based at least in part on the first configuration data and the third configuration data to generate first processed image data to be used by the display panel to display the first image at the first target presentation time; and the controller is programmed to:

detect that the brightness of the display panel changes from the first brightness setting to the second brightness setting, the temperature of the display panel changes from the first temperature value to the second temperature value or both;

instruct the display pipeline to store the second configuration data in the second set of registers of the second image data processing circuitry at a first pipeline configuration time that occurs between the first target presentation time and the first presentation time option;

instruct the display pipeline to store the fourth configuration data in the first set of registers of the first image data processing circuitry at the first pipeline configuration time when an entry that indicates the first presentation time option as the second target presentation time of the second image is stored in the time stamp queue before a panel configuration time that occurs between the first pipeline configuration time and the first presentation time option; and instruct the display pipeline to store the third configuration data in the first set of registers of the first image data processing circuitry at the first pipeline configuration time when the entry is not stored in the time stamp queue before the panel configuration time to enable display of the first image to be updated based at least in part on the second brightness setting, the second temperature value, or both.

7. The electronic device of claim 1, wherein the display panel is configured to:

determine display duration of the first image while the first image is being displayed; and refresh display of the first image at the second presentation time option when the display duration of the first image at the second presentation time option is greater than a duration threshold and the first pre-notification signal is not received before the first presentation time option.

8. The electronic device of claim 1, wherein the controller is programmed to:

determine whether the second target presentation time of the second image is equal to a third presentation time option that occurs after the second presentation time option before a second time that occurs between the first time and a first pipeline configuration time that occurs between the first target presentation time and the first presentation time option when the second target presentation time of the second image is not equal to the second presentation time option; and output a second pre-notification signal at the second time that instructs the display panel to pause self-refreshes until after the second image is displayed when the second target presentation time of the second image is equal to the third presentation time option.

9. The electronic device of claim 8, wherein the controller is programmed to:

determine whether the second target presentation time of the second image is equal to a fourth presentation time option that occurs after the third presentation time option before a third pre notification time that occurs between the second time and the first pipeline configuration time; and output a third pre-notification signal at the third time that instructs the display panel to pause self-refreshes until after the second image is displayed when the second target presentation time of the second image is equal to the fourth presentation time option.

10. The electronic device of claim 1, wherein:

the maximum refresh rate of the display panel is 60 Hz;

the first presentation time option occurs a 60 Hz frame duration after the first target presentation time; and the second presentation time option occurs one quarter of the 60 Hz frame duration after the first presentation time option.

11. The electronic device of claim 1, wherein the electronic device comprises a portable phone, a media player, a personal data organizer, a handheld game platform, a tablet device, a computer, an electronic watch device, or any combination thereof.

12. A method for operating processing circuitry to manage a refresh operation of a display, comprising:

determining a next presentation time option;

determining if an indication of a first image having a first target presentation time that is equal to the next presentation time option is received before a first time;

in response to the indication of the first image not being received, determining if an indication of a second image having a second target presentation time occurring within a duration after the next presentation time option is received before a second time; and in response to the indication of the second image being received, enabling a frame pre-notification configured to pause a display self-refresh of the display.

13. The method of claim 12, wherein the next presentation time option is determined based on a minimum display duration corresponding to a maximum refresh rate, an additional minimum display duration, or any combination thereof.

14. The method of claim 12, comprising:

retrieving a pipeline configuration;

configuring a display pipeline with the pipeline configuration;

processing image data of the second image; and transmitting the image data of the second image for display at the second target presentation time.

15. The method of claim 12, comprising:

popping a time stamp queue comprising the first target presentation time and a pointer to configuration data;

referencing the pointer to the configuration data to retrieve the configuration data; and in response to the indication of the first image being received, preparing image data of the first image for display based on the configuration data.

16. The method of claim 12, comprising:

in response to the indication of the second image not being received, determining an additional next presentation time option based on a maximum refresh rate; and receiving the second image having the second target presentation time before a third time, wherein the third time is based on a pipeline configuration time and the second target presentation time.

17. A method of operating processing circuitry to manage a refresh operation of a display, comprising:

displaying an image based on received image data;

determining if a display duration corresponding to the image displayed is greater than a threshold;

in response to the display duration being greater than the threshold, determining if a frame pre-notification signal is received, wherein the frame pre-notification signal corresponds to a subsequent image for presentation and is configured to be issued prior to a processing of image data corresponding to the subsequent image; and in response to the frame pre-notification signal being received, pausing the refresh operation of the display.

18. The method of claim 17, comprising:

receiving second image data corresponding to the frame pre-notification signal;

displaying a second image based on the second image data; and resetting the display duration.

19. The method of claim 17, comprising:

in response to the display duration not being greater than the threshold, continuing to display the image displayed; and incrementing the display duration.

20. The method of claim 17, comprising:

in response to the frame pre-notification signal not being received, refreshing the image displayed by repeating the received image data to refresh one or more electrical signals used to display the image displayed; and resetting the display duration.

* * * * *